US006122794A

United States Patent [19]

Atkins

[11] Patent Number: 6,122,794

[45] Date of Patent: Sep. 26, 2000

[54] SWIMMING POOL CLEANER COMPONENT

[75] Inventor: David Seagrave Atkins, Muldersdrift, South Africa

[73] Assignee: Zodiac Pool Care, Inc., Ft. Lauderdale, Fla.

[21] Appl. No.: 09/214,578

[22] PCT Filed: Sep. 29, 1997

[86] PCT No.: PCT/US97/17631

§ 371 Date: Jun. 10, 1999

§ 102(e) Date: Jun. 10, 1999

[87] PCT Pub. No.: WO98/14678

PCT Pub. Date: Apr. 9, 1998

[30] Foreign Application Priority Data

Oct. 3, 1996 [ZA] South Africa ..... 96/8310

[51] Int. Cl.[7] ..... E04H 4/16

[52] U.S. Cl. ..... 15/246; 15/1.7

[58] Field of Search ..... 15/1.7, 246; 210/169

[56] References Cited

U.S. PATENT DOCUMENTS

| | | | |
|---|---|---|---|
| 3,046,583 | 7/1962 | Drennan | 15/1.7 |
| 4,023,227 | 5/1977 | Chauvier | 15/1.7 |
| 4,193,156 | 3/1980 | Chauvier | 15/1.7 |
| 4,530,125 | 7/1985 | Hofmann . | |
| 4,642,833 | 2/1987 | Stoltz et al. | 15/1.7 |
| 4,949,419 | 8/1990 | Kallenbach . | |
| 5,014,382 | 5/1991 | Kallenbach . | |
| 5,418,995 | 5/1995 | Rice et al. . | |
| 5,421,054 | 6/1995 | Dawson et al. . | |
| 5,433,985 | 7/1995 | Atkins . | |
| 5,465,443 | 11/1995 | Rice et al. . | |
| 5,617,606 | 4/1997 | Scott et al. | 15/246 |

FOREIGN PATENT DOCUMENTS

| | | |
|---|---|---|
| 2520421 | 7/1983 | France . |

*Primary Examiner*—Terrence R. Till

*Attorney, Agent, or Firm*—Dean W. Russell; Kilpatrick Stockton LLP

[57] ABSTRACT

An integrally-moulded foot (3) and disc (2) for a swimming pool cleaner is disclosed. The disc (2) optionally may include tapering holes (17) at spaced intervals.

20 Claims, 5 Drawing Sheets

SWIMMING POOL CLEANER COMPONENT

FIELD OF THE INVENTION

This invention relates to a component for a suction operated automatic swimming pool cleaner.

BACKGROUND OF THE INVENTION

Several kinds of swimming pool cleaners have been developed which operate on suction generated by the swimming pool filtration plant. Usually these cleaners require a flexible disc to hold the cleaner against the surface being cleaned and a wear resistant foot which runs over the surface. The foot is moulded to have a stepped configuration so that water can pass under the disc and foot carrying detritus into the cleaner body and thence to be caught in a collection trap or the pool filter.

The foot is firmly resiliently engaged on the body and the disc engaged in a peripheral recess around the foot so that it can rotate around the foot. The components are made of different materials and are costly components of the cleaner.

OBJECT OF THE INVENTION

The Applicant has monitored the wear and tear on many cleaners and the object of this invention is to provide a component which will materially reduce the cost of manufacture of the pool cleaner while in no way reducing its efficacy in use.

SUMMARY OF THE INVENTION

According to this invention there is provided a swimming pool cleaner component comprising a foot and flexible disc moulded as an integral unit.

Further features of this invention provide for the foot to be rotatable on and supported by the body of the pool cleaner, for the shape of the foot to generally conform to a truncated conical shape and for the inner edges of the surface engaging parts of the foot to be more rigid than the outer edges.

The invention also provides for the disc to have a ring of reduced thickness around the foot and to have radially extending ribs of reduced thickness and a series of venturi openings spaced apart from the foot symmetrically there around. The surface of material around the openings in contact in use with a surface being cleaned will preferably be dished to ensure a very thin suction at the opening.

The invention also provides for the upper surface of the foot to provide a series of sand traps facilitating the transport of sand cleaned from the pool through the cleaner.

The outer edge of the disc will preferably be of serrated shape with short upward projections extending from the peaks of the serrations.

It is a feature of this invention that the component can be moulded from a polyvinyl chloride composition.

BRIEF DESCRIPTION OF THE DRAWINGS

These and other features of this invention will become apparent from the following description of two examples illustrated in the accompanying drawings in which.

DETAILED DESCRIPTION OF THE DRAWINGS

Figure 1:
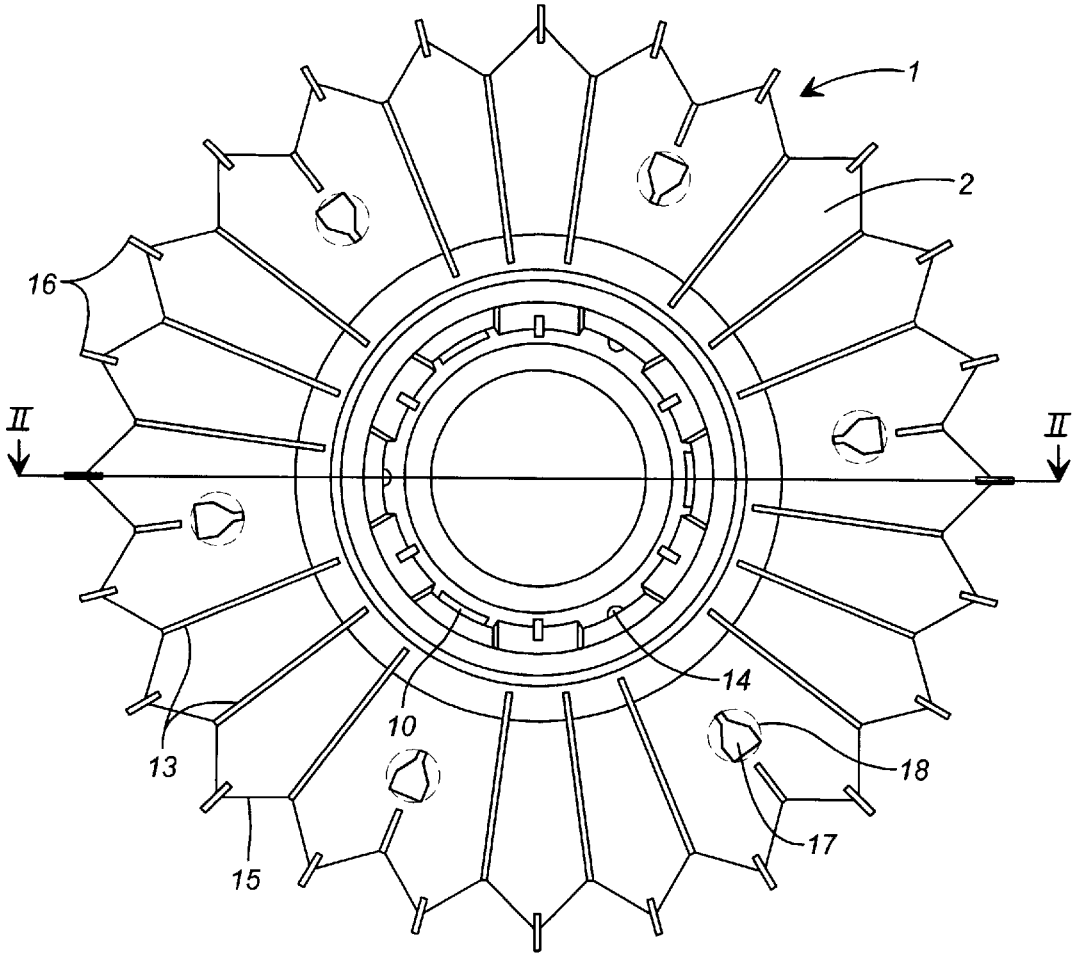
FIG. 1 is a plan view of the cleaner component in accordance with a first embodiment of the invention.

As shown the component 1 for a swimming pool cleaner is preferably moulded of polyvinyl chloride material. This material is chosen to be cross-linkable to enable wear resistance characteristics to be varied to predetermined degrees. The component is designed so that this material can be used without distorting hoop stresses developing in the component during curing. This is achieved by the construction described below.

The component 1 consists of a peripheral annular disc part 2 integrally moulded with a central boss part forming a foot 3 for the pool cleaner. The base of the foot is of truncated conical shape as indicated at 4. This gives a stability to the structure while allowing the base 5 of the foot 3 to be flexible around its outer edges. The conical section emphasises the ability of the foot to deform at the surface being cleaned and so tend to cling to projections and corners formed, for example, by steps on the surface to be cleaned. The normally circular opening into the foot can be given different elongated shapes to assist the facility. Gussets 6 are provided symmetrically spaced around the foot 3 extending between the central and horizontal sections.

An annular inwardly facing rim 7 is provided to rotatably engage in a groove provided around the bottom of a pool cleaner body (not shown).

The base of the foot 3 is of stepped configuration with the lower sections 8 providing the parts of the foot engaging the surface being cleaned during use of the pool cleaner. The indented stepped sections 9 on the bottom surface provide flow openings into the body of the pool cleaner from underneath the foot and disc. The outer part of the surface engaging sections is more flexible than the smaller diameter inner sections.

Further openings 10 through the wall of the base part of the foot 3 allow flow of water above the disc into the pool cleaner body.

The foot 3 is joined to the flexible annular disc 2 by a ring 12 of thin sectioned material which provide great flexibility of the disc 2 relative to the foot 3.

Radially extending upstanding hinge sections 13 of reduced section material are symmetrically distributed across the upper surface of the disc 2 providing both flexibility to the disc and guide paths for sand and other detritus over the top surface of the disc towards the pockets formed between the stepped sections of the foot 3. These hinge sections also enable the effects of hoop stresses occurring during moulding and curing to be overcome. Escape holes 14 are provided through the walls of the pockets not providing flow openings 10 into the body of the cleaner. The intention is to allow escape of sand which may otherwise accumulate.

These hinge sections 13 and the ring 12 of reduced sectioned material ensure a flexibility to the disc which enables it to move over or around obstacles encountered during cleaning of a pool and substantially prevents the cleaner from becoming jammed.

The edge 15 of the disc 2 is serrated and short upstanding and outwardly projecting fins 16 extend from the apices of the serrations.

Venturi shaped holes 17 are provided through the disc at spaced intervals. The disc below these holes 17 is dished as indicated at 18 to provide thin edges around the periphery of the holes. These holes improve the flow characteristics of the water over the surface of the disc into the body of the pool cleaner.

It will be appreciated that the construction described above results in a highly flexible and efficient disc and foot combination which has a central part providing adequate support to hold the body of a pool cleaner properly orientated during use. It further provides substantial cost savings in the manufacture of the components by reduction both in the amount of material required and in the kind of material that can be used in the moulding of the combined components.

Figure 2:
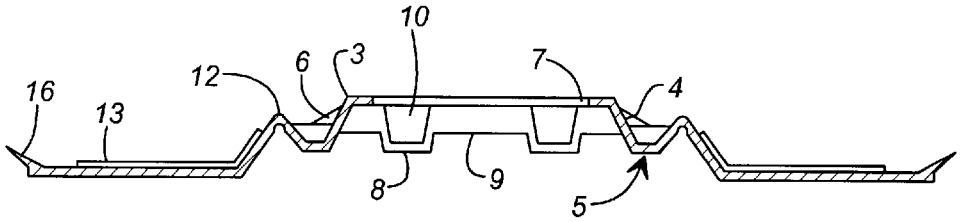
FIG. 2 is a diametral section through the central part of the component on section II—II.
Figure 3:
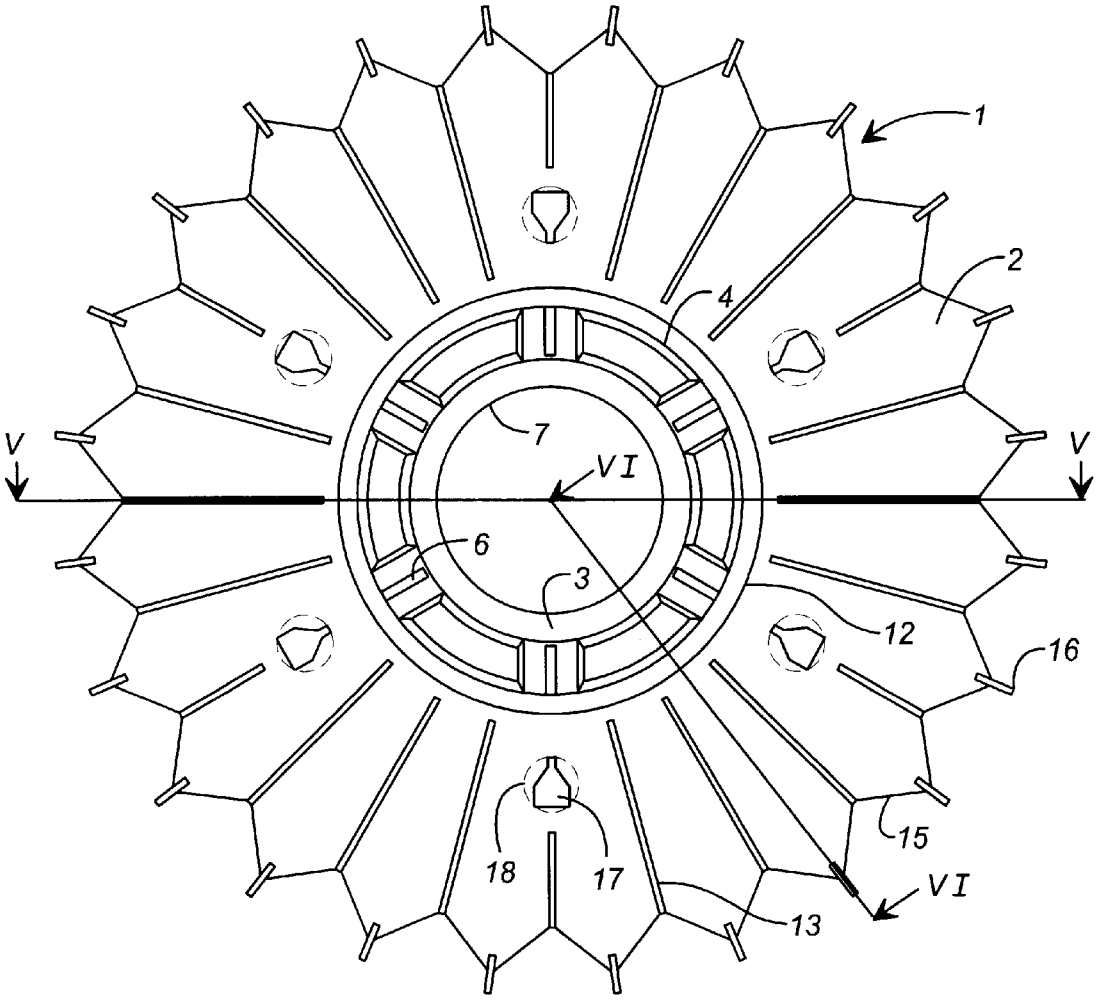
FIG. 3 is a plan view of a second embodiment of the invention.
Figure 5:
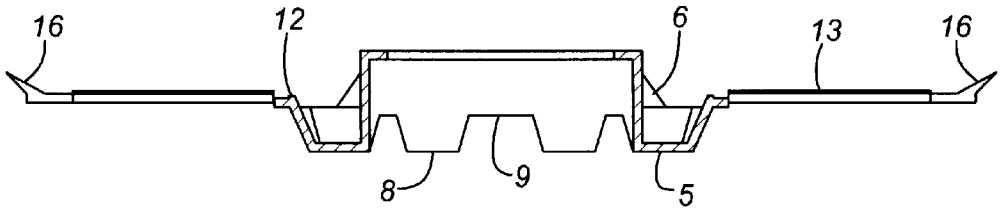
FIG. 5 is a diametral sectional elevation on section V—V.

Referring to FIGS. 3 to 10, many features are the same as are shown in FIGS. 1 and 2 and the same reference numerals for these features are used. The description of FIGS. 1 and 2 is referred to. No escape holes 14 are provided in this second embodiment. They are not important to have. The venturi shaped holes 17 are so called because they provide a narrowing passage for the radially inward flow of water through the holes, accelerating this flow. Hence the comment that they improve the flow characteristics of the water over the disc into the body of the pool cleaner.

Figure 4:
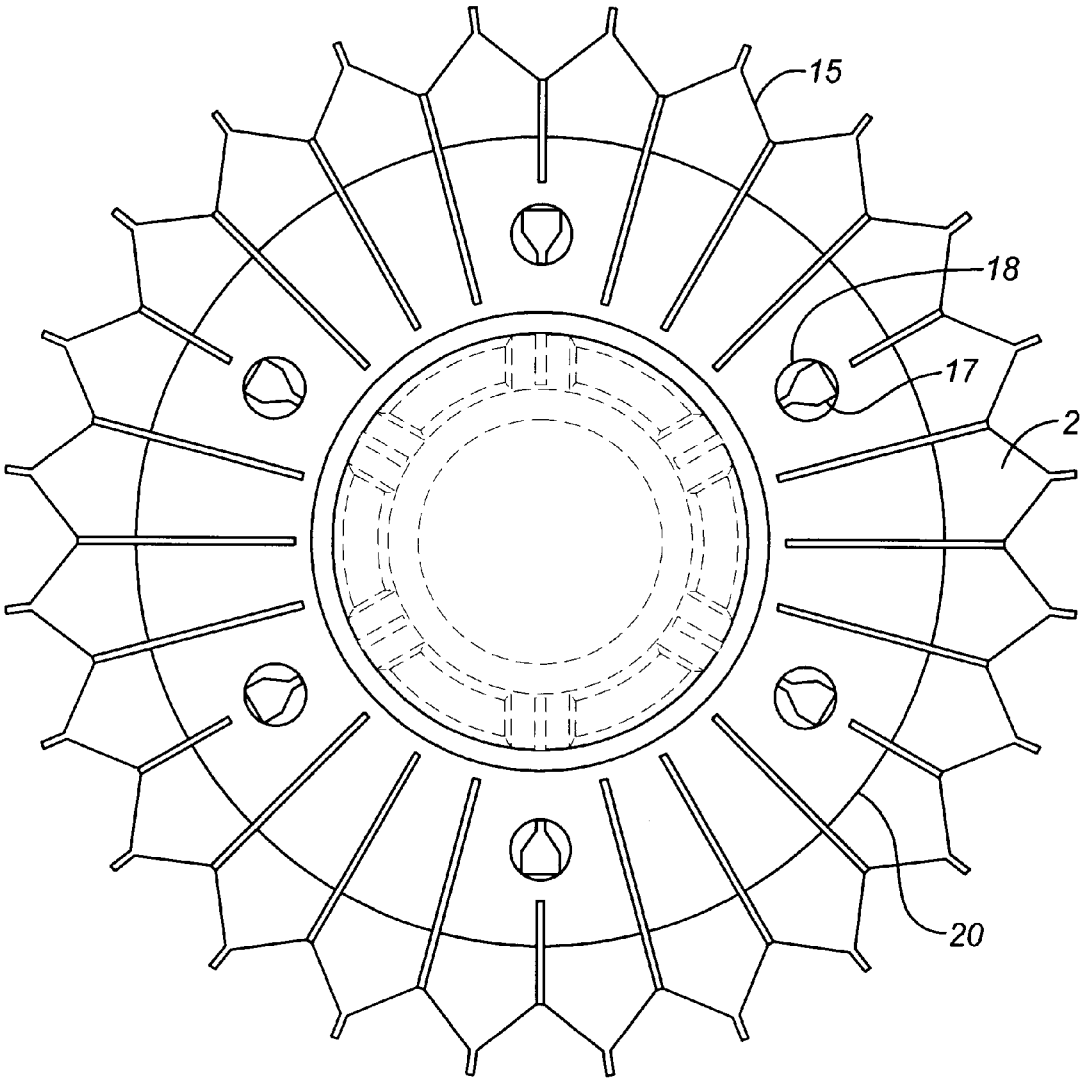
FIG. 4 is an underneath view of the second embodiment.
Figure 6:
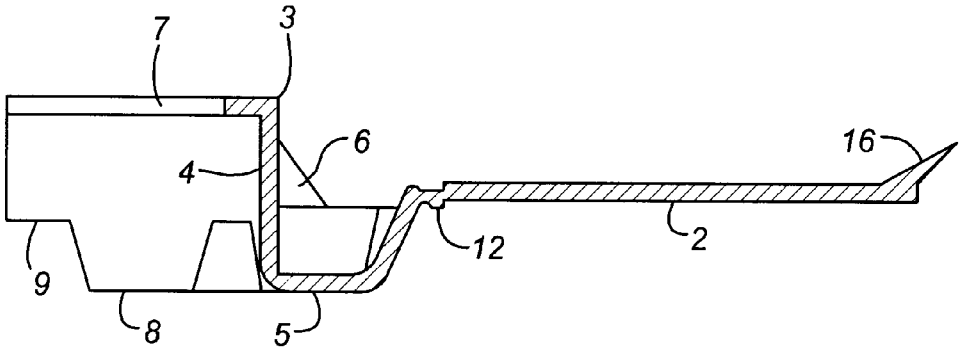
FIG. 6 is an enlarged partial diametral sectional elevation on section VI—VI.
Figure 7:
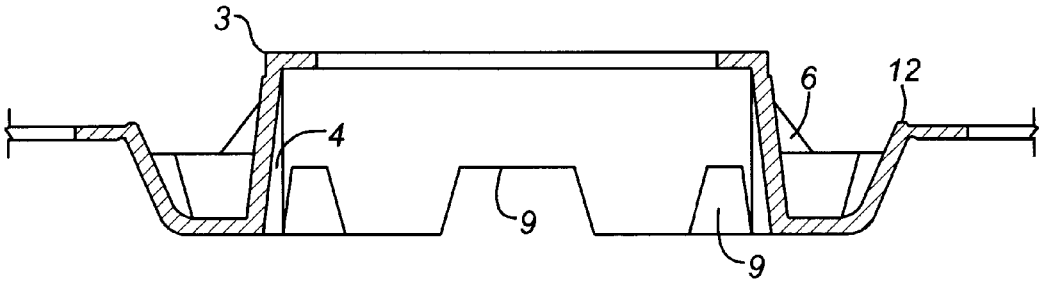
FIG. 7 is an enlarged diametral section through the central part on section V—V.
Figure 8:
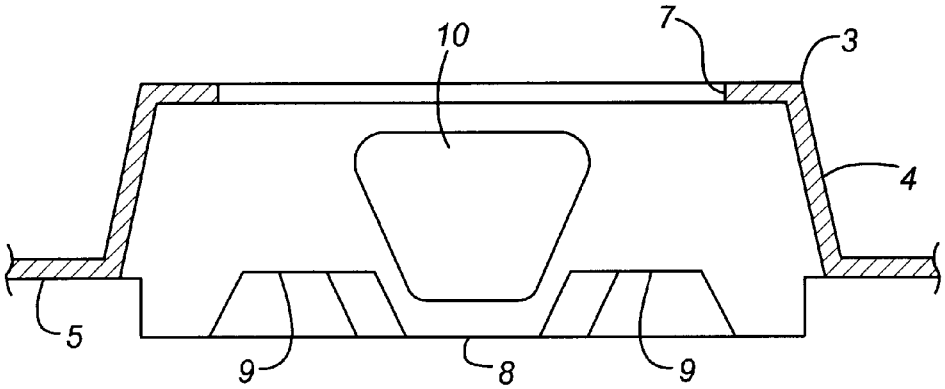
FIG. 8 is an enlarged diametral section through the central point on section VI—VI.
Figure 9:
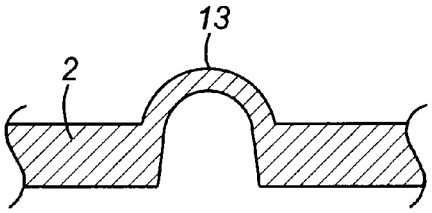
FIG. 9 is a partial sectional elevation showing a hinge detail.
Figure 10:
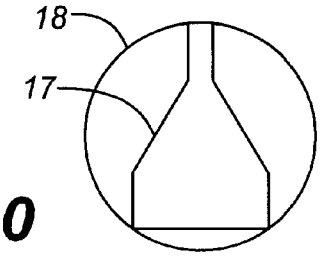
FIG. 10 is a plan view showing a detail of venturi holes.
Figure 11:
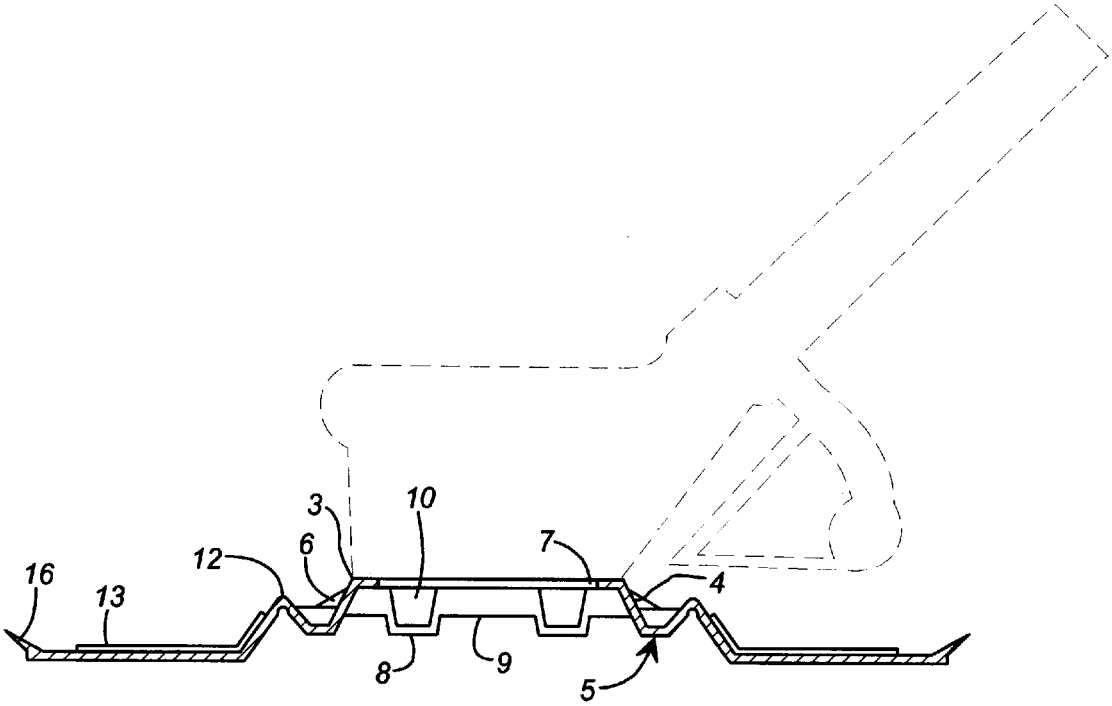
FIG. 11 illustrates the disc of FIG. 2 in connection with a cleaner (shown in broken lines) having a body.

The view of FIG. 4 of the underneath of the disc shows a circle 20 which is the position at which the thickness of the disc 2 commences to reduce radially outwardly to the edge 15. Radially inwardly of the circle 20 the thickness of the disc remains constant.

What is claimed is:

1. For a swimming pool cleaner which consists of a body which has first structure for connection to a flexible suction pipe, second structure for intermittent interruption of a flow of water into the suction pipe and third structure for connection to a foot and flexible disc, a component which comprises:

a foot and a flexible disc moulded as an integral unit, the foot formed as a central boss part with a peripheral base;

the boss part having an upper rim for connection to the third structure of the body part; and the disc formed as an integral outer annular part.

2. A component for a swimming pool cleaner as claimed in claim 1, in which the foot has a truncated conical shape and the rim is inwardly facing.

3. A component for a swimming pool cleaner as claimed in claim 1, in which the boss has indented stepped sections which provide flow openings into the body of the pool cleaner from underneath the integral foot and disc.

4. A component for a swimming pool cleaner as claimed in claim 1, which is provided with openings through the wall of the boss part of the foot above the integral disc to allow flow of water above the disc into the body of the pool cleaner.

5. A component for a swimming pool cleaner as claimed in claim 1, in which gussets are provided symmetrically spaced around the boss of the foot and the inner part of the foot is less flexible than the outer part of the foot.

6. A component for a swimming pool cleaner as claimed in claim 1, which comprises a ring of sectional material which provides flexibility of the disc relative to the foot.

7. A component for a swimming pool cleaner as claimed in claim 1, in which the disc comprises radially extending upstanding hinge sections symmetrically distributed across the upper surface of the disc, providing flexibility to the disc and guide paths for sand and other detritus.

8. A component for a swimming pool cleaner as claimed in claim 1, in which the outer edge of the disc is serrated and short upstanding and outwardly projecting fins extend from the apices of the serrations.

9. A component for a swimming pool as claimed in claim 1, in which tapering holes are provided in the disc at spaced intervals and the material of the disc is dished around the holes to provide thin edges around the periphery of the holes.

10. For a swimming pool cleaner which includes a body which has first structure for connection to a flexible suction pipe, second structure for intermittent interruption of a flow of water into the suction pipe and third structure for connection to a foot and flexible disc, a component which comprises:

a foot and a flexible disc molded as an integral unit, the foot formed as a central boss part with a peripheral base;

the boss part having an upper rim for connection to the third structure of the body part and indented stepped sections which provide flow openings into the body of the pool cleaner from underneath the integral foot and disc; and the disc formed as an integral outer annular part.

11. An automatic swimming pool cleaner for cleaning a surface of a swimming pool, comprising:

a. a body; and b. an integrally-moulded foot and disc, the foot formed as a central boss part with a base which, in use, contacts the surface to be cleaned, the boss part having a rim for connection to the body, and the disc formed as an integral outer annular part surrounding the boss part.

12. An automatic swimming pool cleaner according to claim 11 in which the disc is flexible and has an outer edge which is serrated.

13. An automatic swimming pool cleaner according to claim 12 in which the disc has an upper surface and a lower surface and at least part of the rim is above the upper surface of the disc when the disc is oriented horizontally with its lower surface adjacent the surface to be cleaned.

14. An automatic swimming pool cleaner according to claim 12 in which, in use, the integrally-formed foot and disc can rotate about the body.

15. An automatic swimming pool cleaner according to claim 14 in which the disc has an upper surface and a lower surface and at least part of the rim is above the upper surface of the disc when the disc is oriented horizontally with its lower surface adjacent the surface to be cleaned.

16. An automatic swimming pool cleaner according to claim 11 in which, in use, the integrally-formed foot and disc can rotate about the body.

17. An automatic swimming pool cleaner according to claim 16 in which the disc has an upper surface and a lower surface and at least part of the rim is above the upper surface of the disc when the disc is oriented horizontally with its lower surface adjacent the surface to be cleaned.

18. An automatic swimming pool cleaner according to claim 11 in which the disc has an upper surface and a lower surface and at least part of the rim is above the upper surface of the disc when the disc is oriented horizontally with its lower surface adjacent the surface to be cleaned.

19. A disc adapted for use as part of an automatic swimming pool cleaner, comprising:

a. an upper surface;

b. an aperture for receiving the automatic swimming pool cleaner; and c. a section (i) having the general shape of a truncated cone, (ii) existing intermediate the upper surface and aperture, and (iii) projecting above the upper surface so as to elevate the aperture above the upper surface.

20. An automatic swimming pool cleaner having the disc of claim 19.

* * * * *